US010914326B2

(12) United States Patent
Chuan

(10) Patent No.: US 10,914,326 B2
(45) Date of Patent: Feb. 9, 2021

(54) ENGINE-DRIVEN OIL PUMP

(71) Applicant: KUDOS MECHANICAL CO., LTD., New Taipei (TW)

(72) Inventor: James Chuan, New Taipei (TW)

(73) Assignee: KUDOS MECHANICAL CO., LTD., New Taipei (TW)

( * ) Notice: Subject to any disclaimer, the term of this patent is extended or adjusted under 35 U.S.C. 154(b) by 18 days.

(21) Appl. No.: 16/231,867

(22) Filed: Dec. 24, 2018

(65) Prior Publication Data

US 2020/0191170 A1 Jun. 18, 2020

(30) Foreign Application Priority Data

Dec. 14, 2018 (CN) ..... 2018 1 1532967

(51) Int. Cl.
*F15B 13/08* (2006.01)

(52) U.S. Cl.
CPC ..... *F15B 13/08* (2013.01); *F15B 2211/321* (2013.01)

(58) Field of Classification Search
CPC .. F15B 13/08; F15B 2211/321; F04B 23/021; F04B 49/22; F04B 53/10
See application file for complete search history.

(56) References Cited

U.S. PATENT DOCUMENTS

| | | | | |
|---|---|---|---|---|
| 6,524,084 | B2 * | 2/2003 | Neumair | F04B 23/021 137/454.4 |
| 6,678,972 | B2 * | 1/2004 | Naruse | B60K 6/28 37/466 |
| 6,772,589 | B2 * | 8/2004 | Schienbein | B29C 45/82 60/421 |
| 8,523,139 | B2 * | 9/2013 | Sakamoto | E02F 3/964 251/30.01 |
| 2012/0104294 | A1 * | 5/2012 | Heusser | F15B 13/0857 251/129.01 |

* cited by examiner

*Primary Examiner* — F Daniel Lopez
(74) *Attorney, Agent, or Firm* — Tracy M Helms; Apex Juris, pllc.

(57) ABSTRACT

An engine-driven oil pump has an engine, a pump unit, an oil diverting device, a manual control unit, and a remote control unit. The engine is connected to the pump unit. The oil diverting device is mounted on the pump unit and selectively pumps hydraulic oil from the pump unit into the manual control unit or the remote control unit. With the engine, the engine-driven oil pump can generate power independently instead of relying on external power supply. Besides, the electromagnetic valve of the remote control unit allows the user to remotely control the oil path of the hydraulic oil, so the user is not required to stay along the engine-driven oil pump to manually switch the oil path, and therefore the engine-driven oil pump is more efficient regarding manpower.

16 Claims, 19 Drawing Sheets

ENGINE-DRIVEN OIL PUMP

BACKGROUND OF THE INVENTION

1. Field of the Invention

The present invention relates to an oil hydraulic pump, especially to an engine-driven oil pump that drives the power-driven set such as an electric hydraulic cutter.

2. Description of the Prior Arts

Oil hydraulic devices (e.g. hydraulic cutter and hydraulic crimper) are commonly used in fields of processing hard materials such as steel or other metals. The power of such devices is provided by an oil hydraulic pump specifically designed to drive the hydraulic device of a particular kind, and the oil hydraulic pump comprises a motor and a control valve. After the motor is electrified, it can be used to drive the hydraulic oil inside the control valve, pushing the hydraulic oil into the hydraulic device or pulling the hydraulic oil out from the hydraulic device and back into the control valve. By pushing the hydraulic oil back and forth, a piston inside the hydraulic device is moved and can therefore drive the hydraulic device to do work such as cutting or crimping.

For example, when the hydraulic device is a hydraulic cutter, after the motor is electrified, the user may manually open a gate inside the control valve, so the hydraulic oil inside the control valve can flow from the control valve into the hydraulic device. By the force of the motor, the hydraulic oil may move between the control valve and the hydraulic cutter, so the piston in the hydraulic cutter is moved by the movement of the hydraulic oil. Hence, the hydraulic cutter is driven to cut objects such as cables. The details of the operating method for the hydraulic cutter (especially regarding the piston) are conventional and need no repeat.

However, the conventional hydraulic devices have the following two defects.

First, because the motor requires electricity, the suitable sites of installing the hydraulic device are critically restricted. Locations such as mountains or seaside might not be suitable if there is no nearby power supply.

Second, although the hydraulic device is ready for use after the motor is electrified, one of the features of the hydraulic device is that every single movement of the piston inside the hydraulic device depends on the flowing of the hydraulic oil. In other words, the user needs to stand by the machine and manually switch the path of the oil to operate the piston, so as to operate the cutter. Furthermore, most of the objects to be cut, such as the aforementioned cables and steels, cannot be cut through at once due to the thickness and the hardness of said materials, so the user has to manually operate the hydraulic device for quite a while to control the switch of the oil path, and this may cause the inefficiency on manpower.

To overcome the shortcomings, the present invention provides an engine-driven oil pump to mitigate or obviate the aforementioned problems.

SUMMARY OF THE INVENTION

The main objective of the present invention is to provide an engine-driven oil pump that replaces the motor with an engine that can provide electricity independently, so the present invention can be used in places regardless of the power supply restrictions.

The engine-driven oil pump has an engine, a pump unit, an oil diverting device, a manual unit housing, and a remote control unit. The pump unit connects to the engine and comprises an oil tank and an oil pumping device. The oil tank has an oil inlet channel and an oil outlet channel. The oil inlet channel is mounted in the oil tank. The oil outlet channel is connected to the oil tank. The oil diverting device connects to and communicates with the oil outlet and comprises a diverting passage. A tube inlet, a manual diverting opening, and a remote diverting opening are formed on the diverting passage and mutually communicate with one another. The tank inlet further connects to and communicates with the oil outlet channel. The oil diverting device selectively closes the manual diverting opening. The oil diverting device selectively closes the remote diverting opening.

The manual control unit is connected to the manual diverting opening and the oil inlet channel. The manual control unit comprises a manual unit housing and a manual oil regulator. Two manual unit outlets are formed on the manual unit housing, a first manual unit channel and a second manual unit channel are formed in the manual unit housing, and the first manual unit channel and the second manual unit channel communicates with the two manual unit outlets respectively. A third manual unit channel is formed in the manual unit housing, and the third manual unit channel communicates with the manual diverting opening. A bore is formed in the manual unit housing, and the bore communicates with the first manual unit channel, the second manual unit channel, and the third manual unit channel. The manual oil regulator is mounted in the bore, and is capable of making the manual diverting opening communicate with any one of the two manual unit outlets.

The remote control unit is connected to the remote diverting opening and the oil inlet channel, and the remote control unit comprises a remote unit housing, an electromagnetic valve, a power supply, and an operating device. Two remote unit outlets are formed on the remote unit housing, a remote unit channel is formed in the remote unit housing, and the remote unit channel communicates with the remote diverting opening and the two remote unit outlets. An inside of the electromagnetic valve communicates with the remote unit channel, and the electromagnetic valve is capable of making the remote diverting opening communicate with any one of the two remote unit outlets. The power supply is electrically connected to the electromagnetic valve. The operating device is signalingly connected to the electromagnetic valve.

Further, two manual pressure adjusting valves are mounted on the manual control unit, and the two manual pressure adjusting valves communicate with the two manual unit outlets respectively. Two remote pressure adjusting valves are mounted on the remote control unit, and the two remote pressure adjusting valves communicate with the two remote unit outlets respectively.

Given the forgoing structure of the engine-driven oil pump, the present invention uses the engine as the power supply, and therefore outside power supply is not required. Instead, the present invention may power up the engine by burning fossil fuels, so it is capable of operating in places where the electricity supply is difficult to acquire.

Besides, the present invention also comprises the electromagnetic valve which can be used to control the oil path, and the user may remotely control the electromagnetic valve. As a result, the user does not need to manually control the oil path during the operating process, which means that the user is allowed to leave the spot to do over work during the operating process, and can remotely control the operation of the present invention. Therefore the present invention is more efficient on manpower than the conventional method of operating the hydraulic device.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
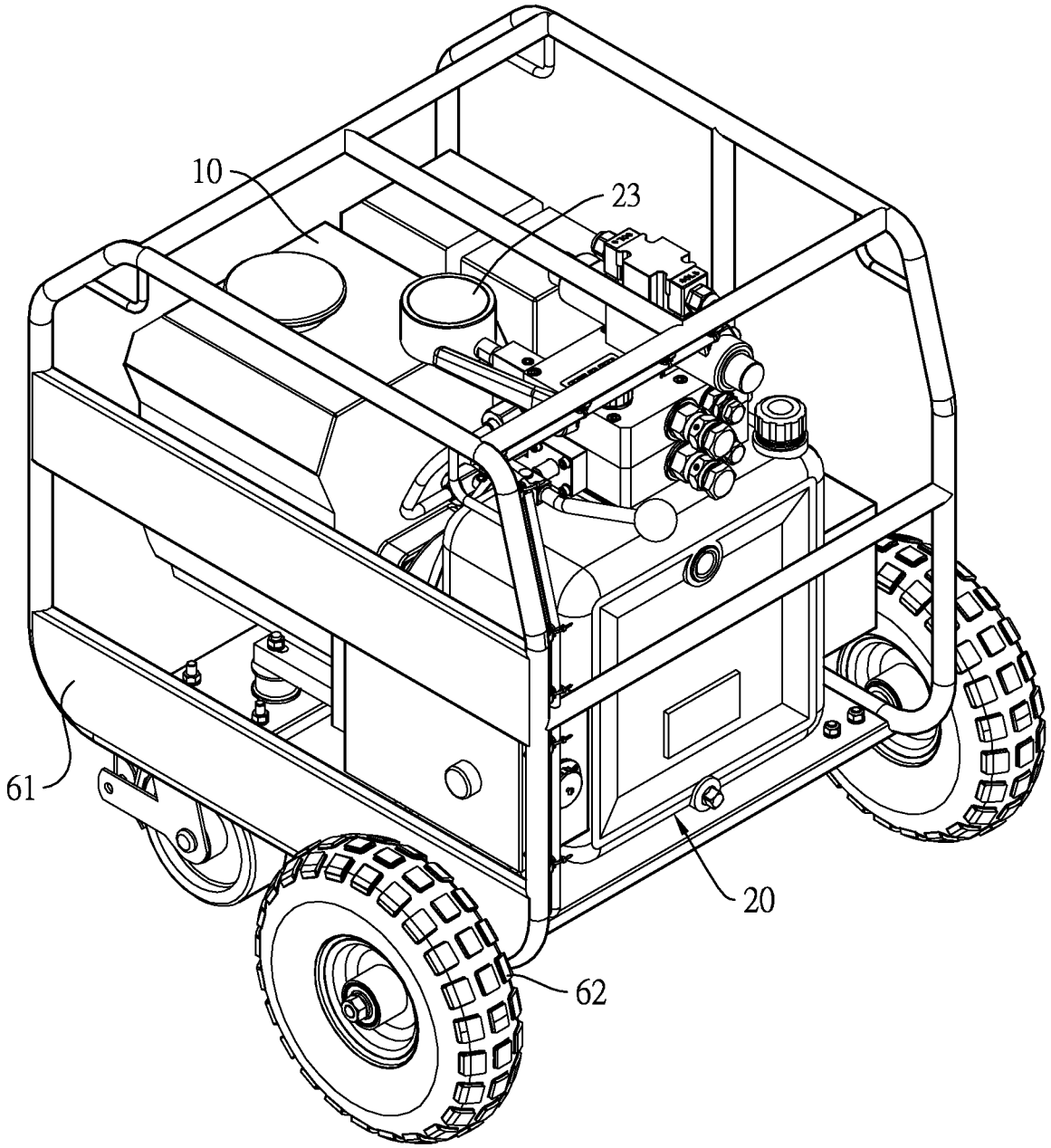
FIG. 1 is a perspective view of an engine-driven oil pump in accordance with the present invention.
Figure 3:
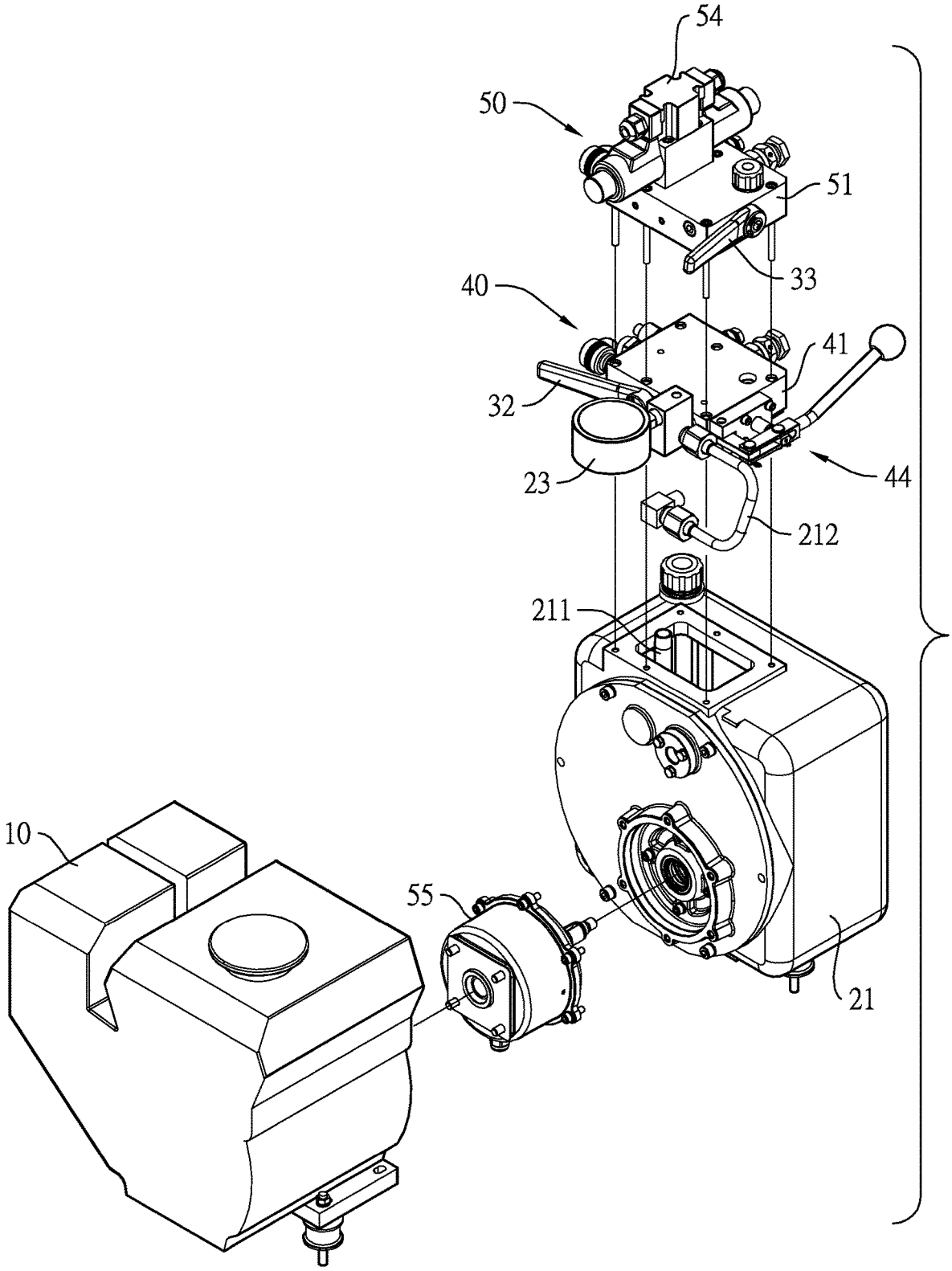
FIG. 3 is a partially exploded view of the engine-driven oil pump in FIG. 1.
Figure 6:
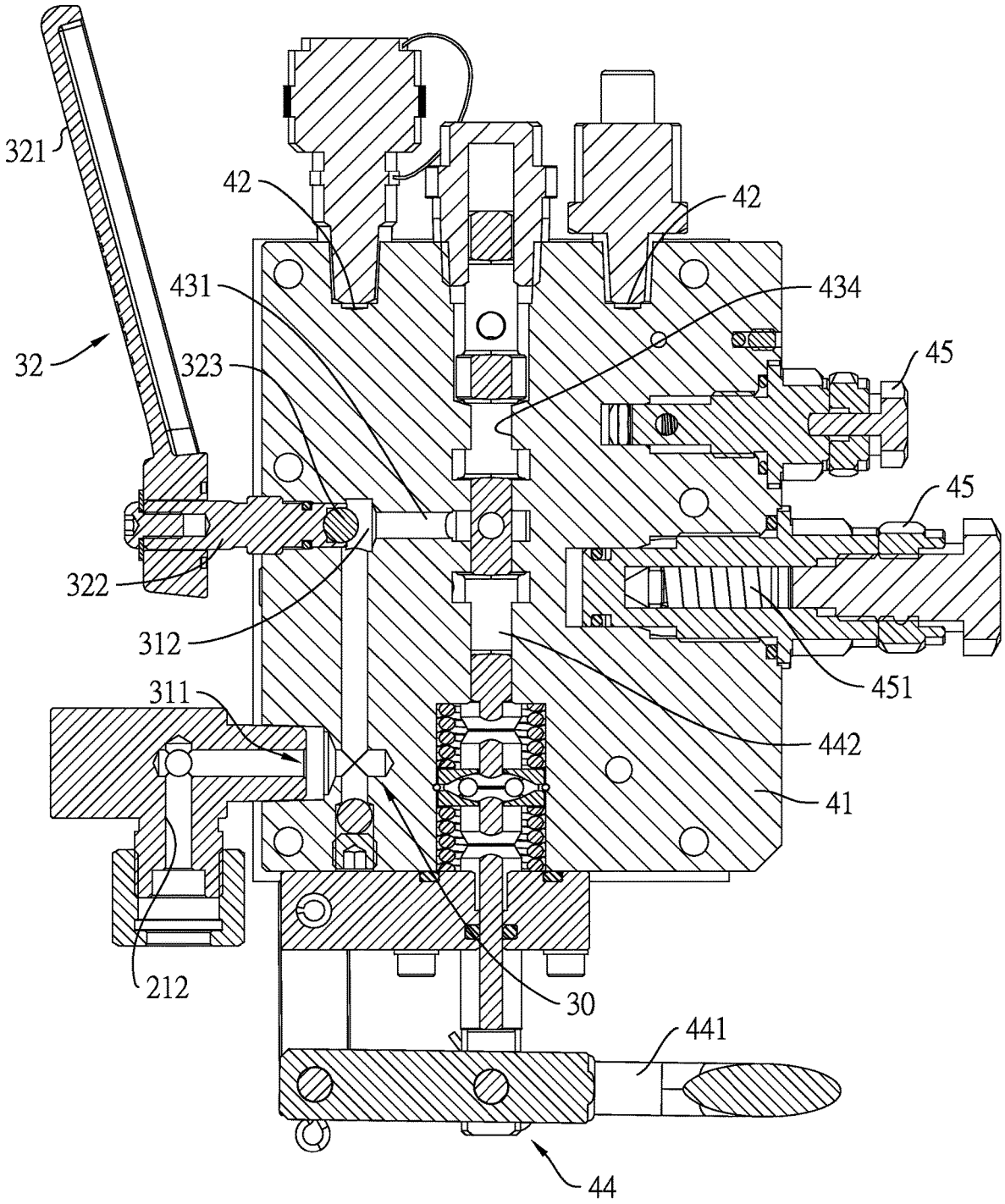
FIG. 6 is a first cross sectional view of the manual control unit in accordance with the present invention.

With reference to FIGS. 1, 3, and 6, an engine-driven oil pump in accordance with the present invention comprises an engine 10, a pump unit 20, an oil diverting device 30, a manual control unit 40, a remote control unit 50 and a supporting device. The engine 10 and the pump unit 20 are electrically connected to each other, and the engine 10 can offer the power for the pump unit 20 to operate. The oil diverting device 30 is connected to the pump unit 20, and the oil diverting device 30 can control the hydraulic oil (not shown in figures) to selectively move into the manual control unit 40 or the remote control unit 50. All the elements mentioned above are mounted on the supporting device.

Figure 2:
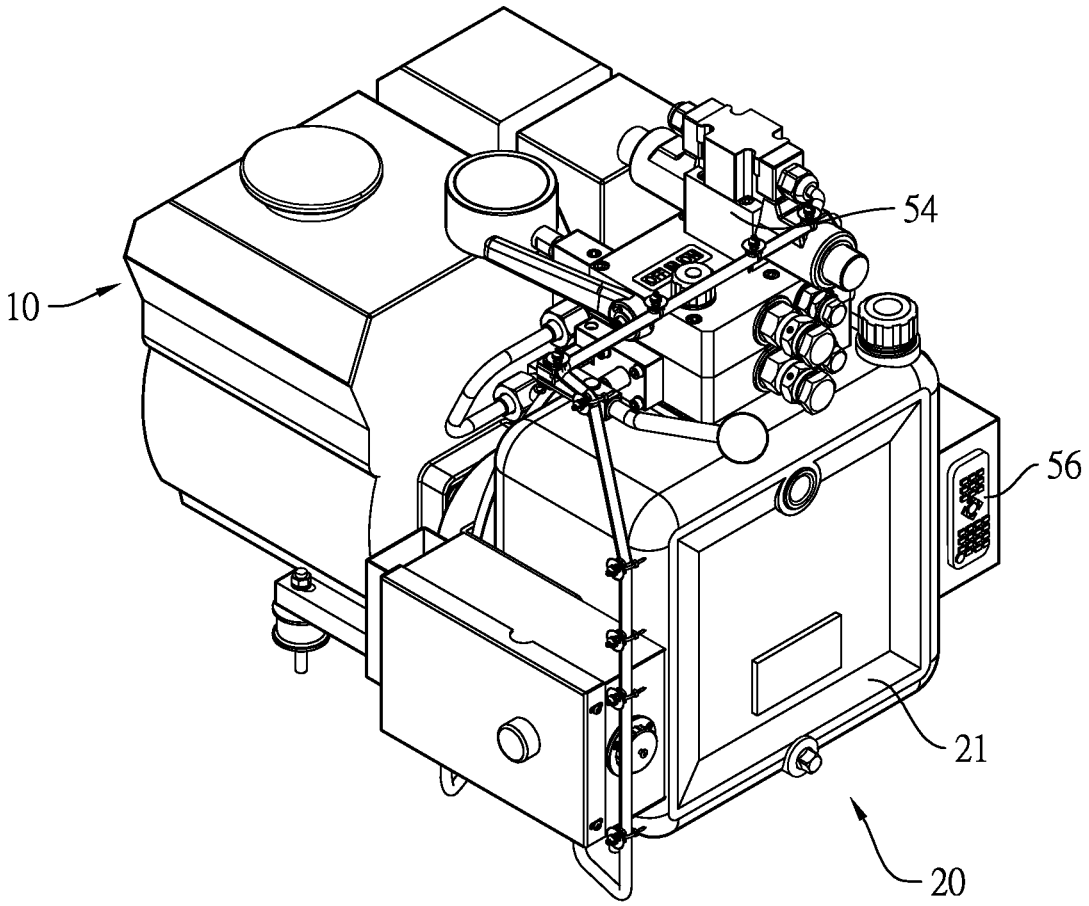
FIG. 2 is a partially enlarged view of the engine-driven oil pump in FIG. 1.
Figure 4:
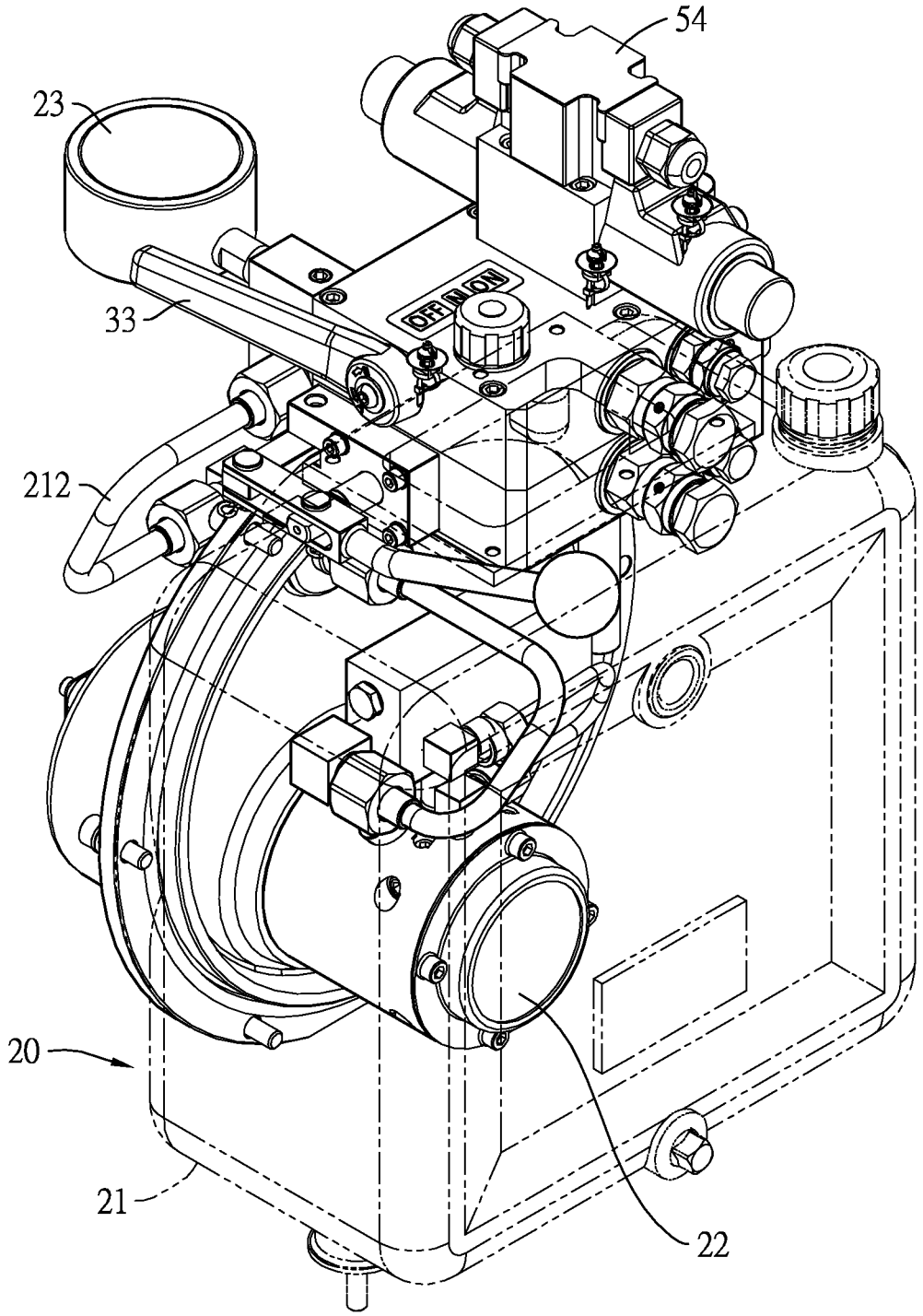
FIG. 4 is a perspective view of the pump unit in FIG. 1.

With reference to FIGS. 2, 3, and 4, the pump unit 20 comprises an oil tank 21, an oil pumping device 22, and an oil pressure gauge 23. An oil inlet channel 211 is formed in the oil tank 21. An oil outlet channel 212 is connected to the oil tank 21. The hydraulic oil can move back into the oil tank 21 through the oil inlet channel 211, and can move out from the oil tank 21 through the oil outlet channel 212.

The oil pumping device 22 is mounted in the oil tank 21, and the oil pumping device 22 can pump the hydraulic oil from the oil tank 21 into the oil outlet channel 212. The oil pressure gauge 23 is connected to and communicating with the oil outlet channel 212. In the present embodiment, the oil pressure gauge 23 is disposed on a top of the oil tank 21. The oil pressure gauge 23 is capable of detecting the oil pressure of the hydraulic oil passing through the oil outlet channel 212.

Figure 5:
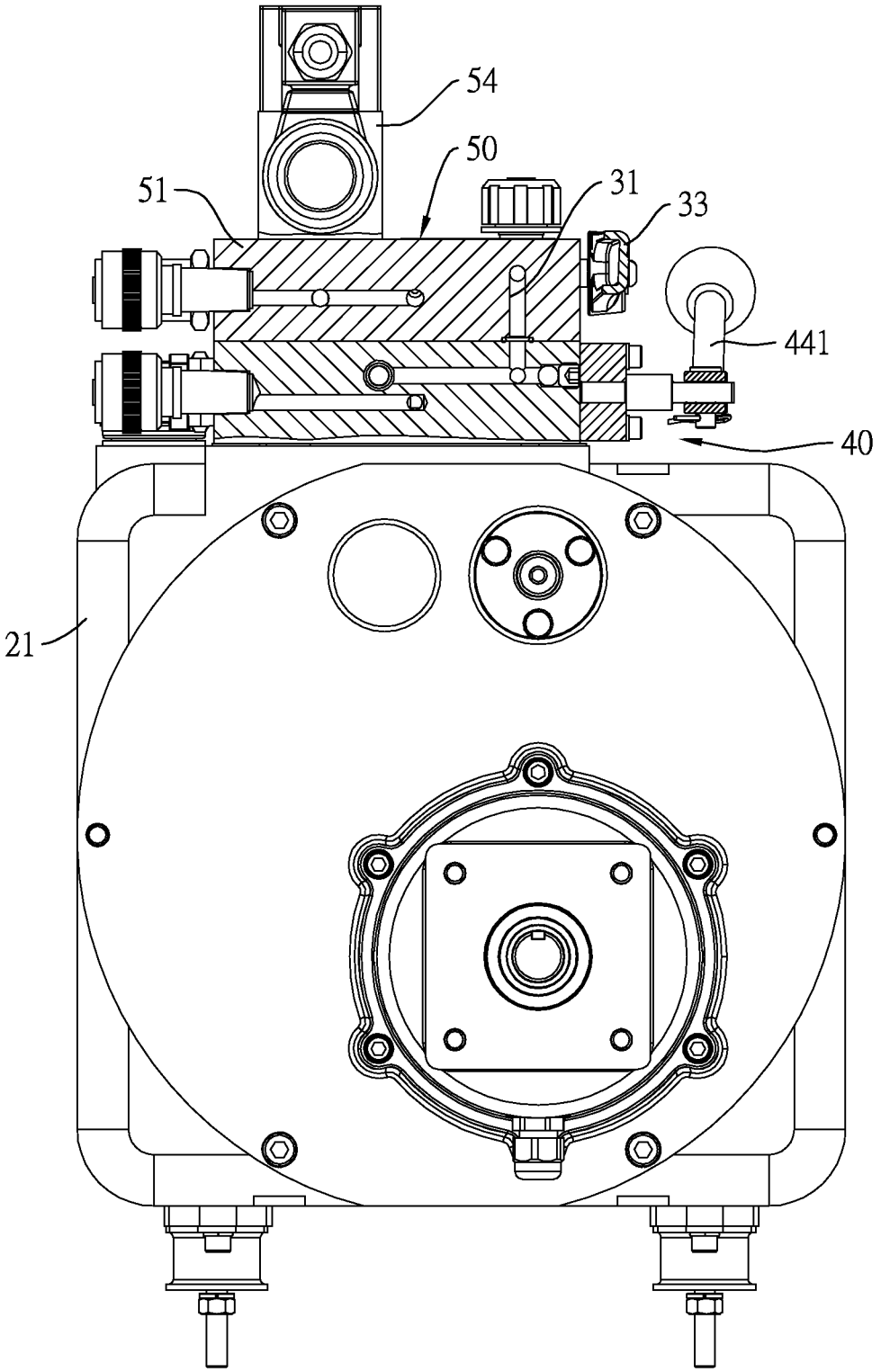
FIG. 5 is a partially cross sectional view of the engine-driven oil pump in FIG. 1.
Figure 11:
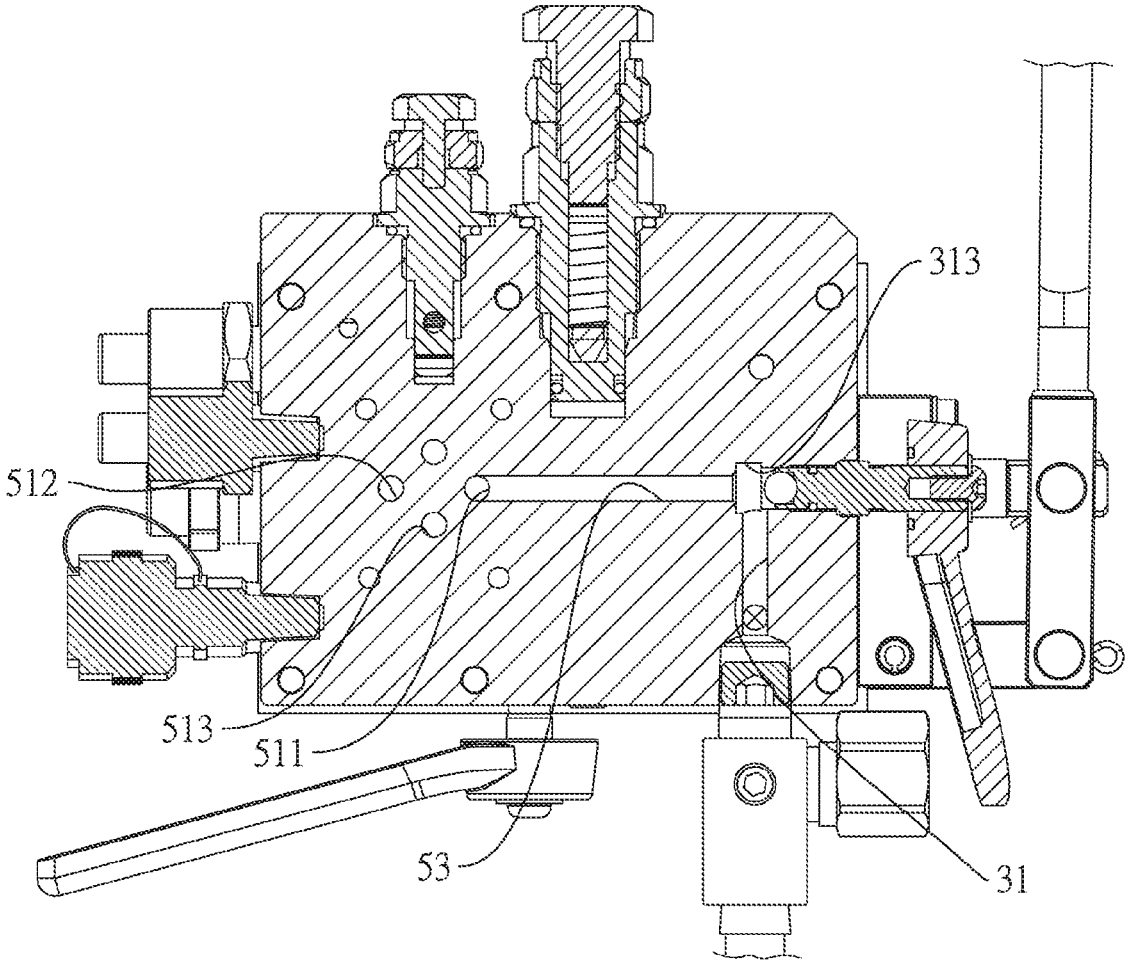
FIG. 11 is a second cross sectional view of the remote control unit in accordance with the present invention.

With reference to FIGS. 5, 6, and 11, the oil diverting device 30 is connected to and communicating with the oil outlet channel 212. The oil diverting device 30 comprises a diverting passage 31 and two diverting valves. In the present embodiment, the two diverting valves are respectively a manual diverting valve 32 and a remote diverting valve 33. The manual diverting valve 32 and the remote diverting valve 33 are respectively mounted on the manual control unit 40 and the remote control unit 50.

The diverting passage 31 has a tube inlet 311, a manual diverting opening 312, and a remote diverting opening 313. The tube inlet 311, the manual diverting opening 312, and the remote diverting opening 313 mutually communicate with one another. Furthermore, the tube inlet 311 connects to and communicates with the oil outlet channel 212. In a preferred embodiment, the oil outlet channel 212 is connected to a valve and the valve is connected to the tube inlet 311. The manual diverting valve 32 and the remote diverting valve 33 are respectively adjacent to the manual diverting opening 312 and the remote diverting opening 313. The manual diverting valve 32 can selectively open or close the manual diverting opening 312. The remote diverting valve 33 can selectively open or close the remote diverting opening 313.

With reference to FIG. 3, in the present embodiment, the manual control unit 40 and the remote control unit 50 are vertically disposed (manual control unit 40 on a bottom, remote control unit 50 on a top) on the oil tank 21, but the disposition is not limited thereto.

With reference to FIGS. 5 and 11, in the present embodiment, the diverting passage 31 is mounted in the manual control unit 40, and one end of the diverting tube 31 extends into the remote control unit 50. The manual diverting opening 312 is formed in the manual control unit 40, and the remote diverting opening 313 is formed in the remote control unit 50.

On the other hand, the manual diverting valve 32 and the remote diverting valve 33 are respectively mounted on the manual control unit 40 and the remote control unit 50. But the location and the disposition of the diverting passage 31 are not limited thereto; in other embodiments, the diverting tube 31 can be formed outside the manual control unit 40 and the remote control unit 50 as an independent tube.

Besides, in another embodiment, the oil diverting device 30 can divert the hydraulic oil by means other than the manual diverting valve 32 and the remote diverting valve 33. For example, the diverting passage can be a Y-shaped channel, and a valve is mounted at the middle of the Y-shaped channel to determine whether the inlet of the diverting passage communicates with the manual diverting opening or the remote diverting opening.

Figure 7:
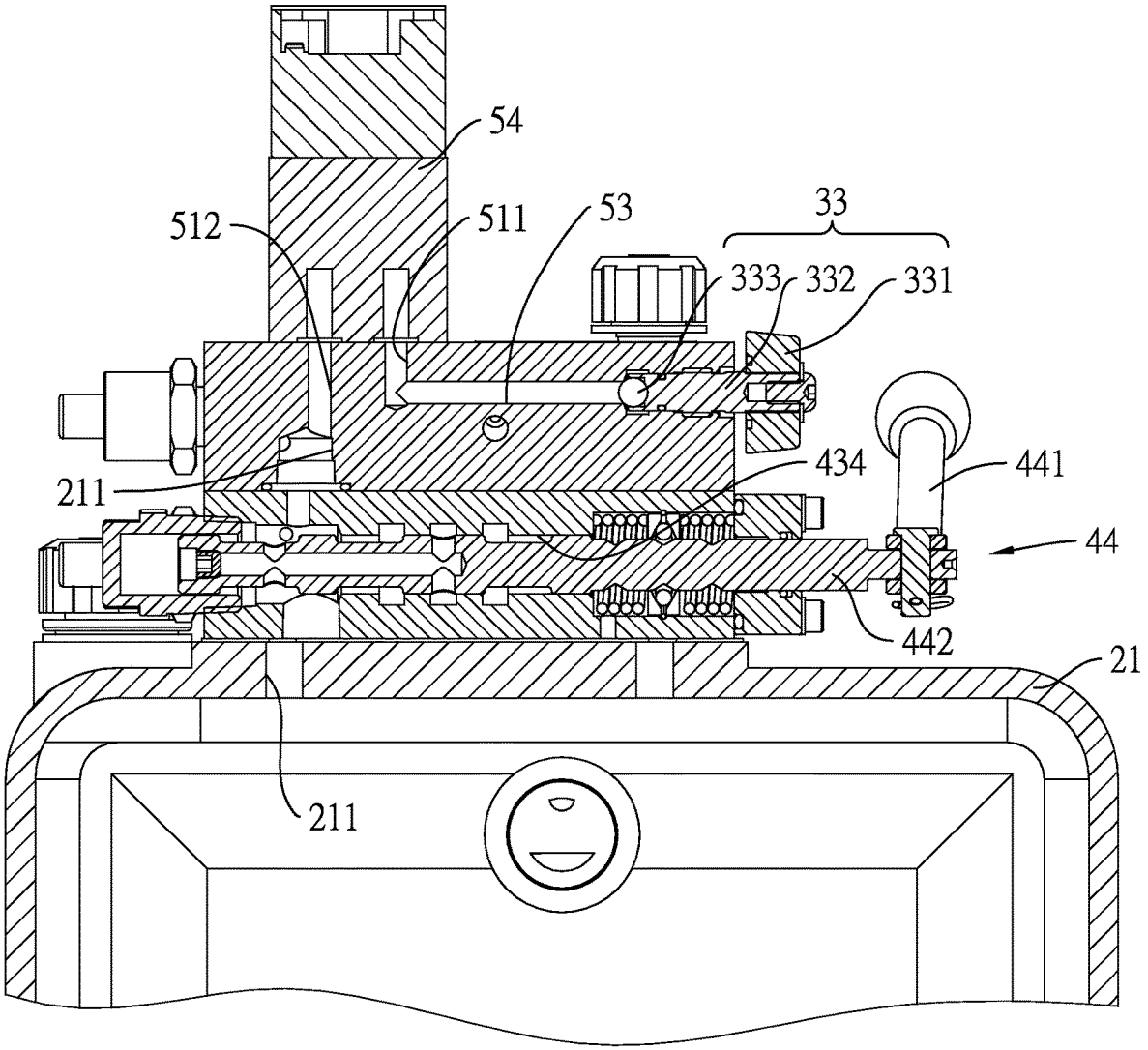
FIG. 7 is another partially cross sectional view of the engine-driven oil pump in FIG. 1.
Figure 8:
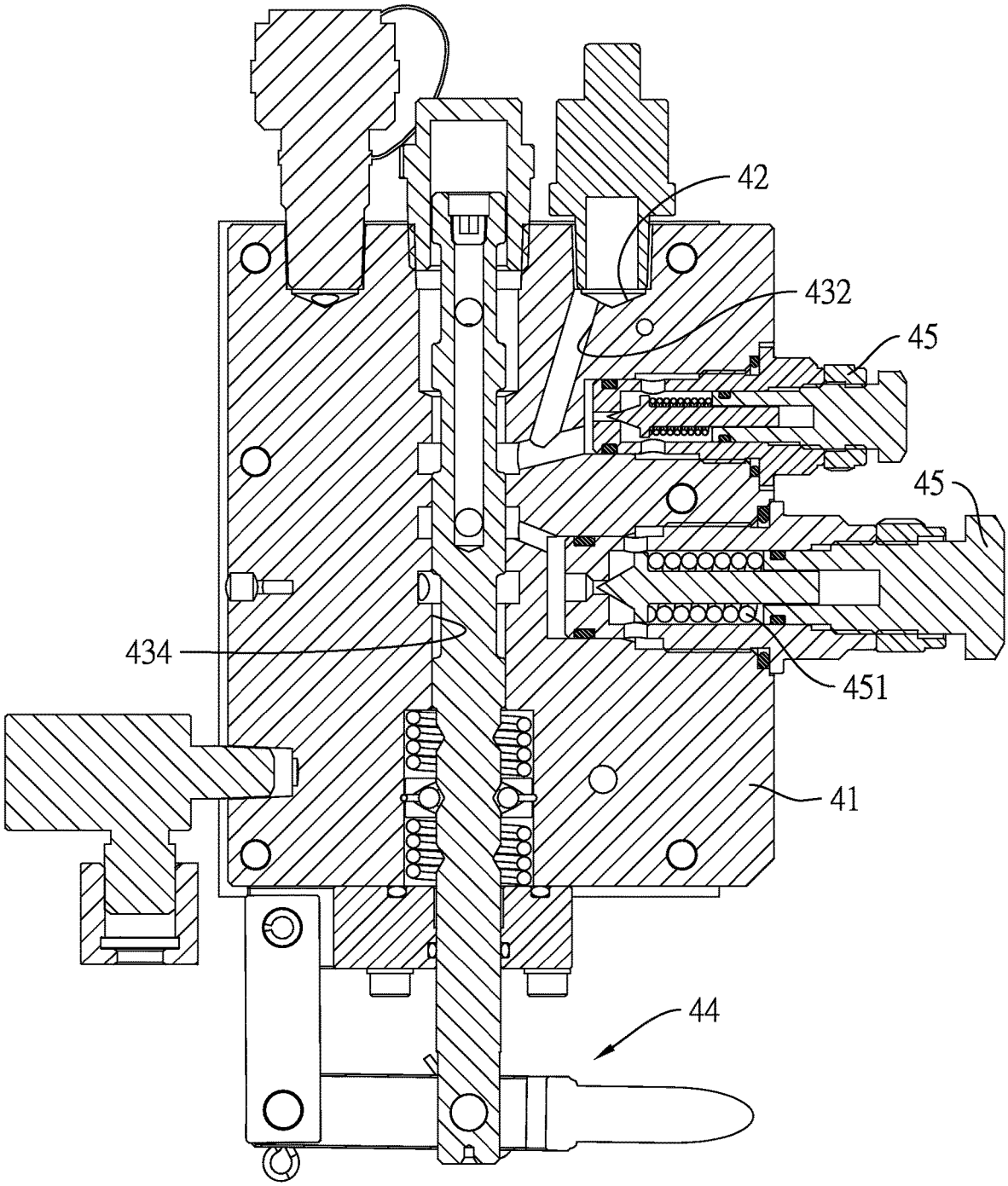
FIG. 8 is a second cross sectional view of the manual control unit in accordance with the present invention.
Figure 9:
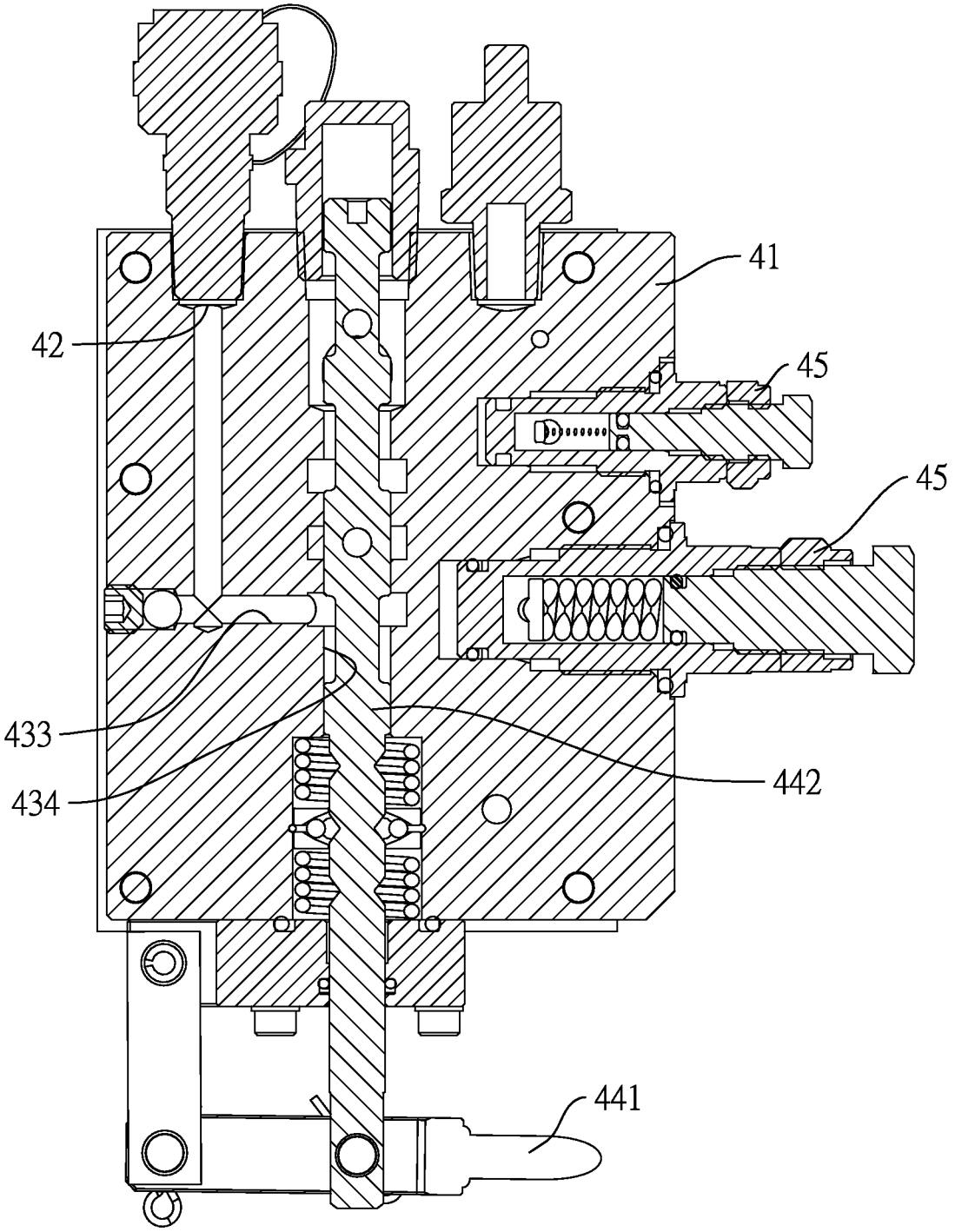
FIG. 9 is a third cross sectional view of the manual control unit in accordance with the present invention.

With reference to FIGS. 5, 6 and 7, in the present embodiment, the manual control unit 40 is disposed on the top of the oil tank 21, and communicates with the manual diverting opening 312 and the oil inlet channel 211 respectively. Furthermore, the manual diverting opening 312, the manual control unit 40 and the oil inlet channel 211 collectively form an oil path cycle. Specifically, the hydraulic oil can flow from the oil tank 21 through the manual diverting opening 312 into the manual control unit 40, and can flow back into the fuel tank 21 through the oil inlet channel 211.

With reference to FIGS. 6, 7, 8, and 9, furthermore, the manual control unit 40 comprises a manual unit housing 41, two manual unit outlets 42, a first manual unit channel 433, a second manual unit channel 432, a third manual unit channel 431, a bore 434, a manual oil regulator 44 and two manual pressure adjusting valves 45. The two manual unit outlets 42 are formed on the manual unit housing 41. The first manual unit channel 433, the second manual unit channel 432, the third manual unit channel 431, and the bore are formed in the manual unit housing 41. The first manual unit channel 433 and the second manual unit channel 432 communicates with a respective one of the two manual unit outlets 42. The third manual unit channel 431 communicates with the manual diverting opening 312. The bore 434 communicates with the first manual unit channel 433, the second manual unit channel 432, and the third manual unit channel 431.

With reference to FIG. 6, specifically, within the aforementioned diverting device 30, the diverting passage 31 is formed in the manual unit housing 41, and the manual diverting opening 312 is also formed in the manual unit housing 41. Meanwhile, the manual diverting valve 32 that is mounted on the manual control unit 40 is mounted on the manual unit housing 41.

The manual diverting valve 32 further comprises a diverting handle 321, an adjusting shaft 322, and a bung 323. The diverting handle 321 is rotatably mounted on the manual unit housing 41 and extends into the third manual unit channel 431 which is also formed in the manual unit housing 41.

The adjusting shaft 322 is mounted in the third manual unit channel 431 and is connected to the diverting handle 321. The bung 323 is mounted in the third manual unit channel 431 and is connected to the adjusting shaft 322. By rotating the diverting handle 321, the user may move the adjusting shaft 322 inside the third manual unit channel 431 and selectively close the manual diverting opening 312 by the bung 323. In other words, after the bung 323 has closed the manual diverting opening 312, the hydraulic oil cannot flow from the oil diverting device 30 to each one of the two manual unit outlets 42 through the third manual unit channel 431, he bore 434, the first manual unit channel 433, and the second manual unit channel 432.

Figure 17:
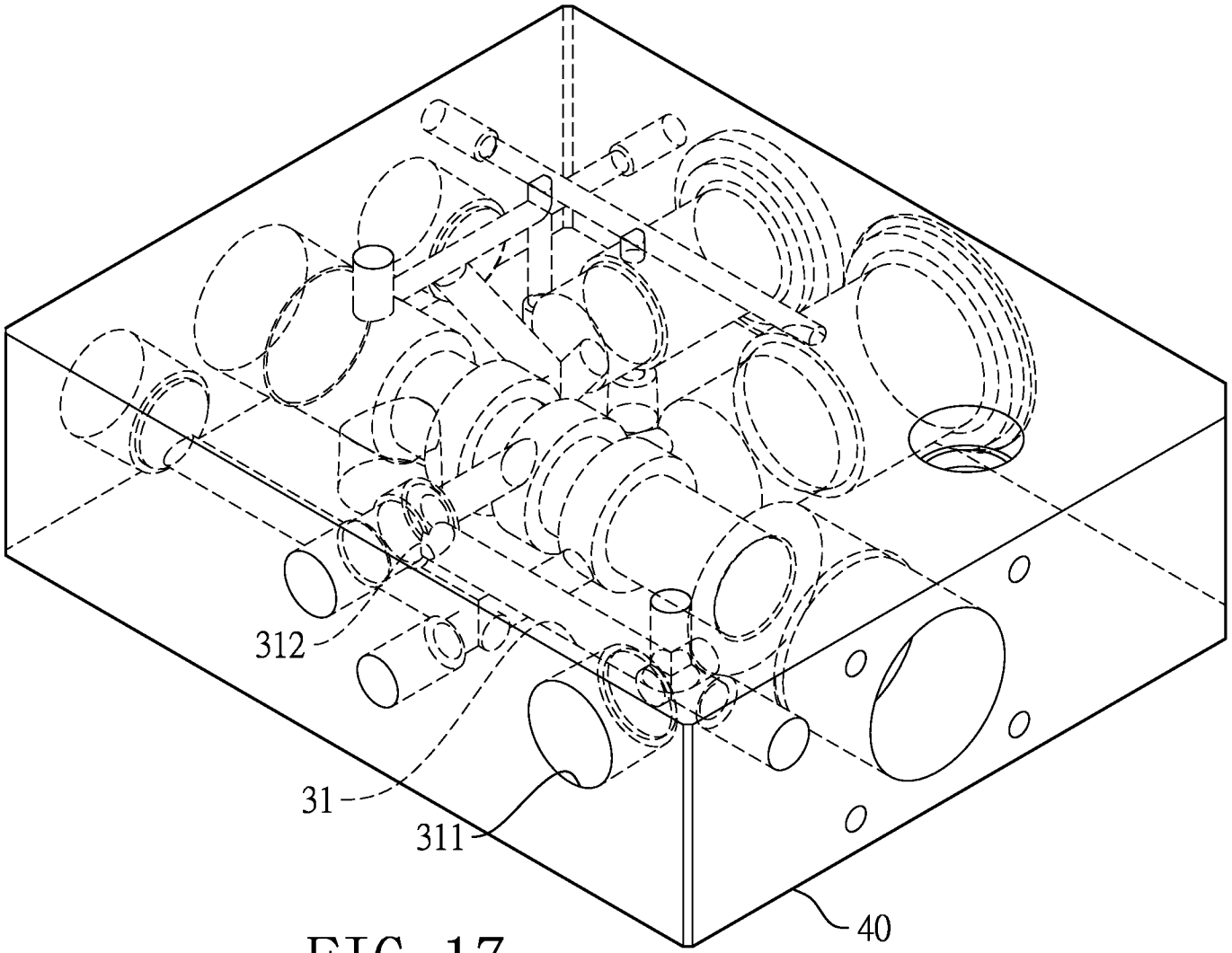
FIG. 17 is a schematic view of the manual control unit.

With reference to FIGS. 6 and 17, the manual oil regulator 44 is mounted in the bore 434. Specifically, the manual oil regulator 44 is mounted in a part of the bore 434 that is after the manual diverting opening 312. That is, after the manual diverting valve 32 has closed the manual diverting opening 312, the manual oil regulator 44 will not contact the hydraulic oil that flows in from the oil diverting device 30.

With reference to FIGS. 6 to 9, in the present embodiment, the manual oil regulator 44 comprises an adjusting handle 441 and a pull rod 442. The adjusting handle 441 is mounted on and protrudes from the manual unit housing 41, and the pull rod 442 is mounted in the bore 434 and is connected to the adjusting handle 441. The user may move the pull rod 442 by pulling the adjusting handle 441 manually. When the manual diverting opening 312 is not closed by the bung 323, the moving of the pull rod 442 inside the bore 434 will affect the final destination of hydraulic oil from the manual diverting opening 312.

Specifically, the adjusting handle 441 is a three-stage rod. When the user pushes the adjusting handle 441 into the deepest end of the manual unit housing 41, the pull rod 442 will also be pushed into the deepest part of the manual unit housing 41. Then, after the hydraulic oil flows into the third manual unit channel 431 through the manual diverting opening 312, the hydraulic oil flows into the bore 434, and then the hydraulic oil flows into the first manual unit channel 433 and the second manual unit channel 432. Finally, the hydraulic oil will then leave the manual unit housing 41 from one of the two manual unit outlets 42.

If the user pulls the adjusting handle 441 to the other end of the manual unit housing 41, thereby moving the pulled rod 442 with it, the hydraulic oil will leave the manual unit housing 41 from the other manual unit outlet 42.

If the user pulls the adjusting handle 441 to a place between the aforementioned two ends, after the hydraulic oil flows into the third manual unit channel 431 from the manual diverting opening 312, the hydraulic oil will flow back into the oil tank 21 through the oil inlet channel 211 without entering the bore 434 and any one of the two manual unit outlets 42. The switching method of the manual oil regulator 44 for the oil path is conventional, so the details need not be specifically stated.

The two manual pressure adjusting valves 45 are mounted on the manual unit housing 41. To be specific, one of the manual pressure adjusting valves 45 is connected to and communicates with one of the manual unit outlets 42 via the second manual unit channel 432. When the oil pressure of the hydraulic oil passing by is too high, it can press and move an adjusting spring 451 that is mounted in the manual pressure adjusting valve 45, so the hydraulic oil will flow into the manual pressure adjusting valve 45, and finally move back into the oil tank 21. Therefore, the manual pressure adjusting valves 45 can control the oil pressure inside the manual unit housing 41, preventing the oil pressure from getting too high.

In the present invention, the term "manual" is defined as: the process of switching the path of the hydraulic oil to either one of the two manual unit outlets 42 is done by the user standing adjacent to the present invention and manually operating the present invention. Specifically, in the present invention, manually operating refers to manually pulling the adjusting handle 441.

Figure 14:
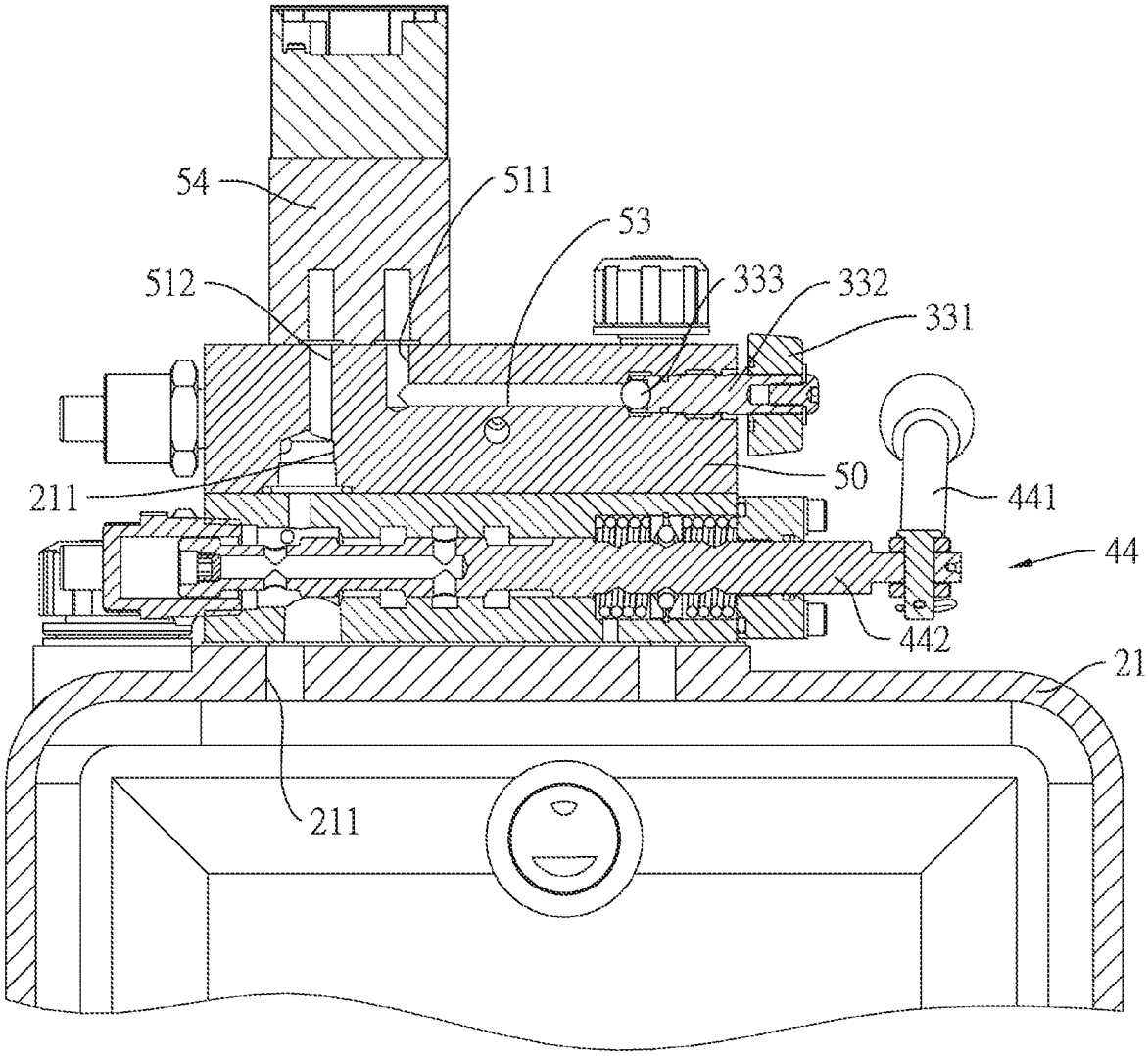
FIG. 14 is another partial cross sectional view of the engine-driven oil pump in FIG. 1.

With reference to FIGS. 3, 11, and 14, in the present embodiment, the remote control unit 50 is mounted above the manual control unit 40, and the remote control unit 50 communicates with the remote diverting opening 313 of the oil diverting device 30 and the oil inlet channel 211. The remote diverting opening 313, the remote control unit 50, and the oil inlet channel 211 collectively form an oil path cycle.

Specifically, after the hydraulic oil enters the remote control unit 50 through the remote diverting opening 313, the hydraulic oil can move back into the oil tank 21 through the oil inlet channel 211. In the present embodiment, the remote control unit 50 and the manual control unit 40 jointly communicate with the oil inlet channel 211. In other words, because the remote control unit 50 is disposed on top of the manual control unit 40, when the hydraulic oil is moving back into the oil tank 21 from the remote control unit 50, the hydraulic oil will enter the manual control unit 40 before it flows back to the oil tank 21. But the oil path is not limited thereto.

Figure 12:
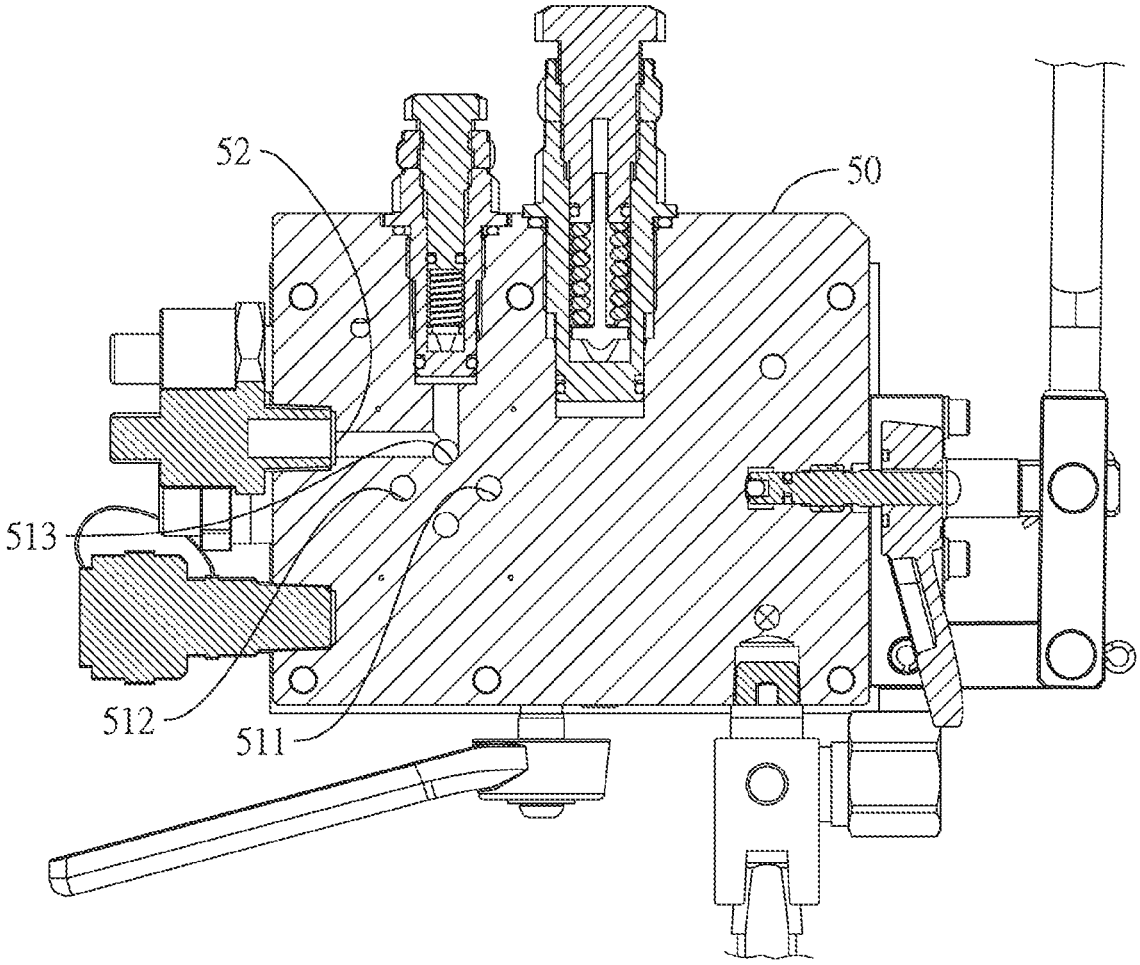
FIG. 12 is a third cross sectional view of the remote control unit in accordance with the present invention.
Figure 13:
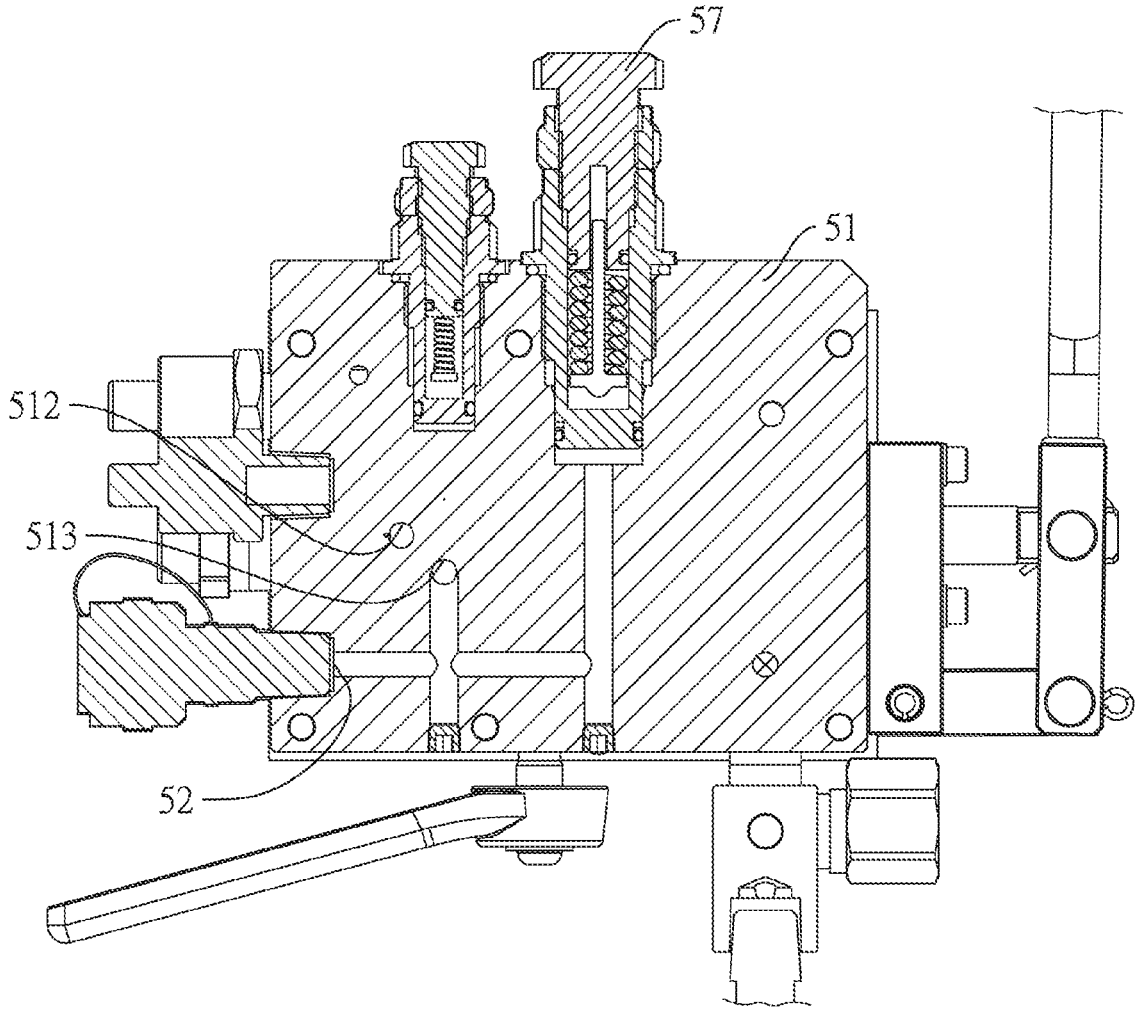
FIG. 13 is a fourth cross sectional view of the remote control unit in accordance with the present invention.

With reference to FIGS. 2, 3, 11, 12, and 19, furthermore, the remote control unit 50 comprises a remote unit housing 51, two remote unit outlets 52, a remote unit channel 53, an electromagnetic valve 54, a power supply unit 55, an operating device 56, and two remote pressure adjusting valves 57 (shown in FIG. 13).

The two remote unit outlets 52 are formed on the remote unit housing 51. The remote unit channel 53 is formed in the remote unit housing 51. The remote unit channel 53 communicates with the two remote unit outlets 52, and also communicates with the remote diverting opening 313. To be specific, the remote unit channel 53 communicates with one of the two remote unit outlets 52 via an inlet communicating hole 511, the electromagnetic valve 54, and one of two pump communicating holes 513. The remote unit channel 53 communicates with the other remote unit outlet 52 via the inlet communicating hole 511, the electromagnetic valve 54, and the other pump communicating hole 513.

Figure 10:
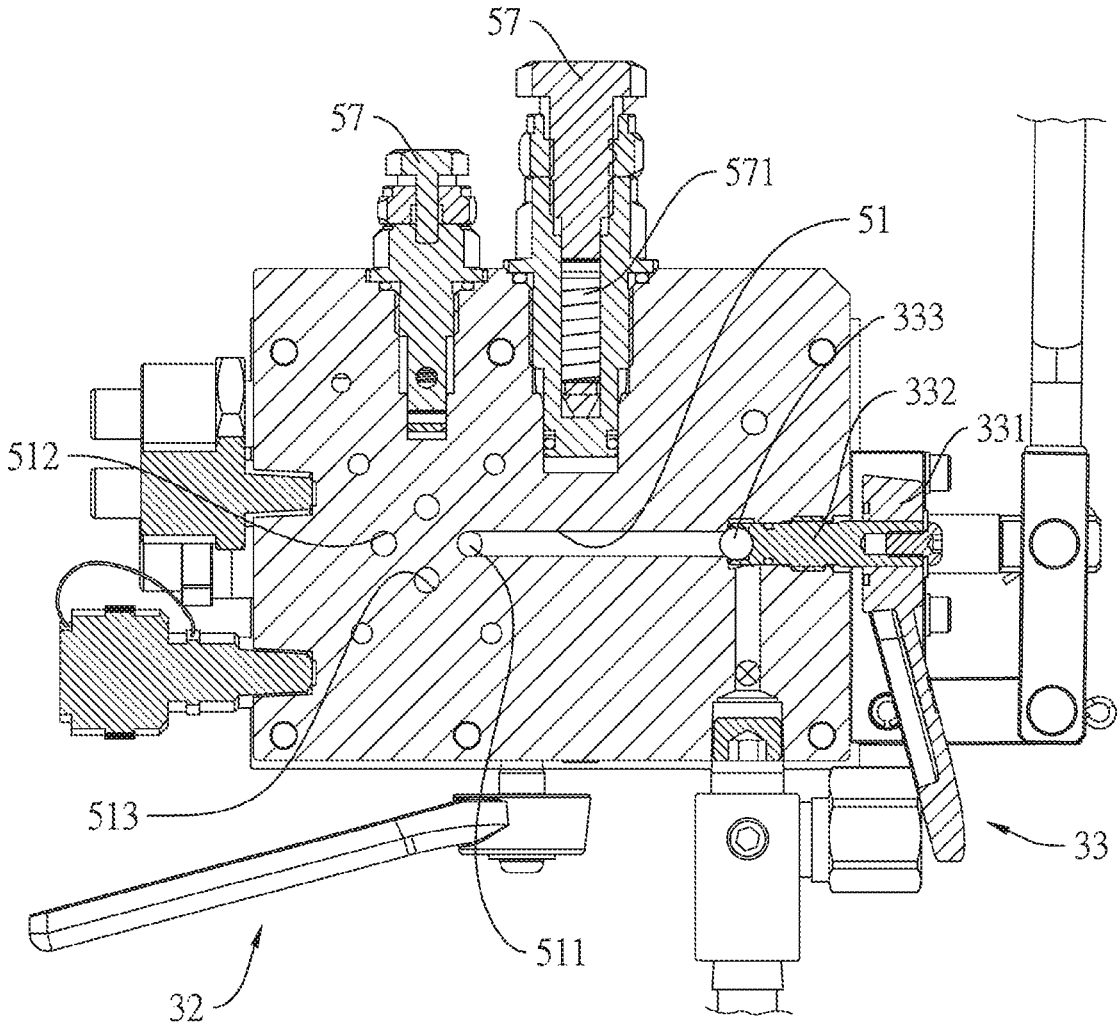
FIG. 10 is a first cross sectional view of the remote control unit in accordance with the present invention.

With reference to FIGS. 10 and 11, specifically, within the aforementioned oil diverting device 30, the diverting passage 31 extends upwardly from the manual unit housing 41 into the remote unit housing 51. The remote diverting opening 313 is formed at the end of the diverting passage 31 that is disposed in the remote unit housing 51. Besides, the remote diverting valve 33 that is mounted on the remote unit housing 51 is structurally identical to the manual diverting valve 32, which means the remote diverting valve 33 also comprises a diverting handle 331, an adjusting shaft 332, and a bung 333.

The diverting handle 331 is rotatably mounted on the remote unit housing 51 and communicates with the remote unit channel 53. The adjusting shaft 332 is mounted in the remote unit channel 53 and is connected to the diverting handle 331. The bung 333 is mounted in the remote unit channel 53 and is connected to the adjusting shaft 332. By rotating the diverting handle 331, the user may move the adjusting shaft 332 inside the remote unit channel 53 and selectively close the remote diverting opening 313 by the bung 333. In other words, after the bung 333 has closed the remote diverting opening 313, the hydraulic oil cannot flow from the oil diverting device 30 to each one of the two remote unit outlets 52 through the remote unit channel 53.

Figure 16:
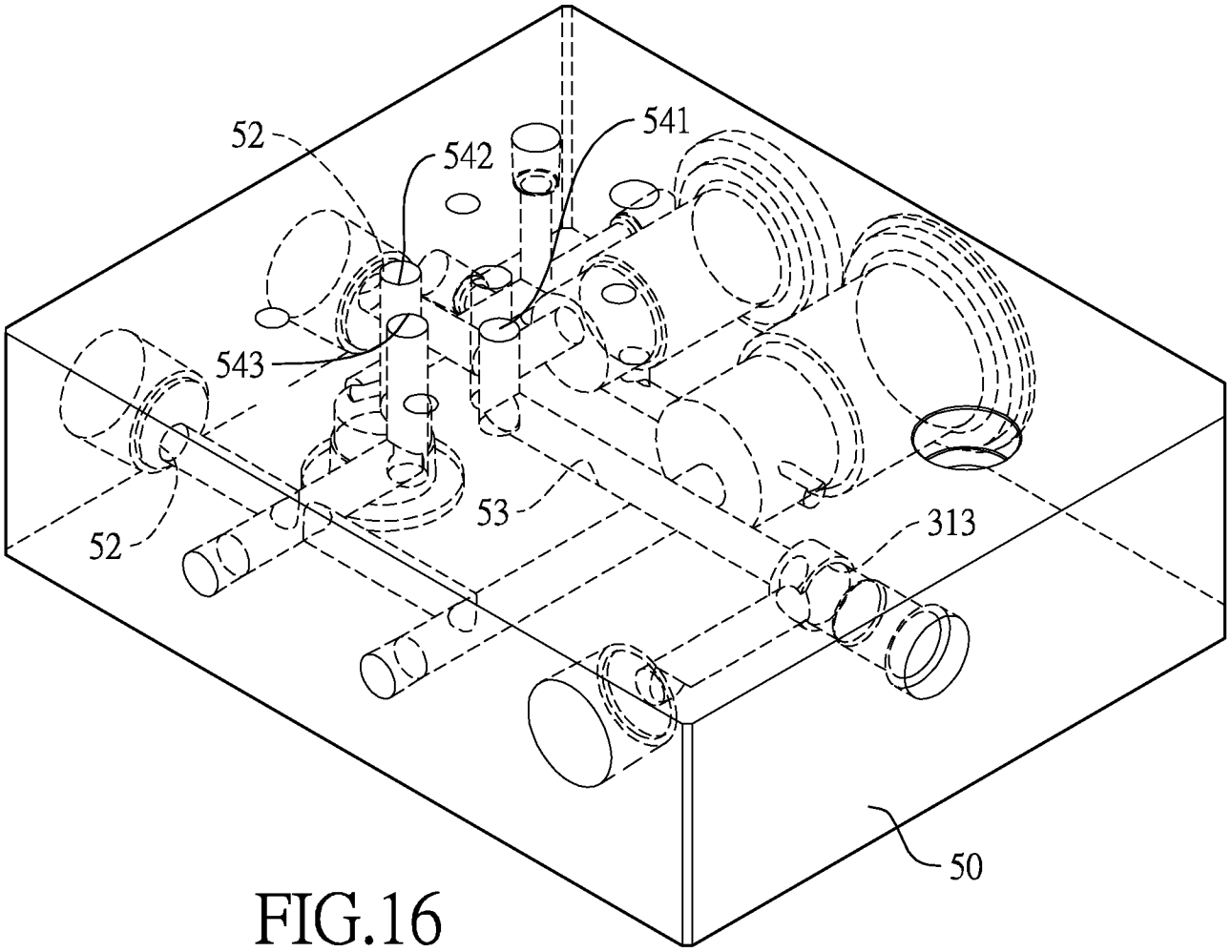
FIG. 16 is a schematic view of the remote control unit.

With reference to FIGS. 3, 10, and 16, the electromagnetic valve 54 is mounted on the remote unit housing 51 and communicates with the remote unit channel 53. Specifically, in the present embodiment, the remote unit housing 51 has the inlet communicating hole 511, an outlet communicating hole 512, and the two pump communicating holes 513 formed on it. The remote unit channel 53 communicates with the inside of the electromagnetic valve 54 through the inlet communicating hole 511. The two remote unit outlets 52 communicate with the inside of the electromagnetic valve 54 through the two pump communicating holes 513 respectively. The two remote unit outlets 52 communicate with the remote unit channel 53 via the electromagnetic valve 54. The outlet communicating hole 512 communicates with the oil inlet channel 211.

With reference to FIGS. 11 and 14, in the present embodiment, after the hydraulic oil enters the remote unit channel 53 of the remote unit housing 51 from the remote diverting opening 313 of the oil diverting device 30, under the condition that the remote diverting valve 33 does not close the remote diverting opening 313, the hydraulic oil will pass through the inlet communicating hole 511 and enter the electromagnetic valve 54. Inside the electromagnetic valve 54 is a movable adjusting shaft (not shown in figures), and the function of electromagnetic valve (said adjusting shaft included) is similar to the structure of the manual oil regulator 44. Specifically, the outlet of the hydraulic oil can be switched by the movement of the adjusting shaft.

Besides, similar to the manual oil regulator 44, the electromagnetic valve 54 is a three-stage device. When the adjusting shaft moves inside the electromagnetic valve 54, it can switch the path of the hydraulic oil, which controls the outlet of the hydraulic oil to be the outlet communicating hole 512 or any one of the two pump communicating holes 513, as shown in FIGS. 12, 13, and 14, therefore achieving the function of switching the oil path. Specifically, the function of the electromagnetic valve 54 is to make the inlet communicating hole 511 communicate with either one of the two pump communicating holes 513 and the outlet communicating hole 512 communicate with the other pump communicating hole 513.

Figure 18:
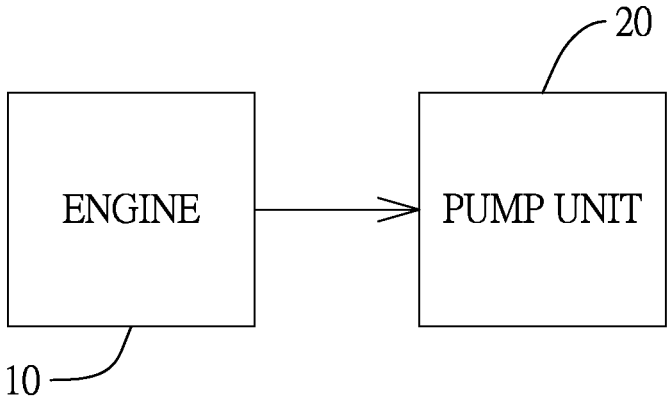
FIG. 18 is a schematic view of an engine and a pump unit.

With reference to FIG. 3 in the present embodiment, the power supply unit 55 is electromagnetic coils, and is mounted between the engine 10 and the pump unit 20. By the driving force of the engine 10, the power supply unit 55 can generate electricity for supply via an electrical connection depicted by the arrows in FIGS. 18 and 19 to the electromagnetic valve 54. However, the power supplying method of power supply unit 55 and the electromagnetic valve 54 is not limited thereto, and in other embodiments, the power supply unit 55 depicted in FIGS. 18 and 19 flow charts can be structures other than electromagnetic coils.

Figure 19:
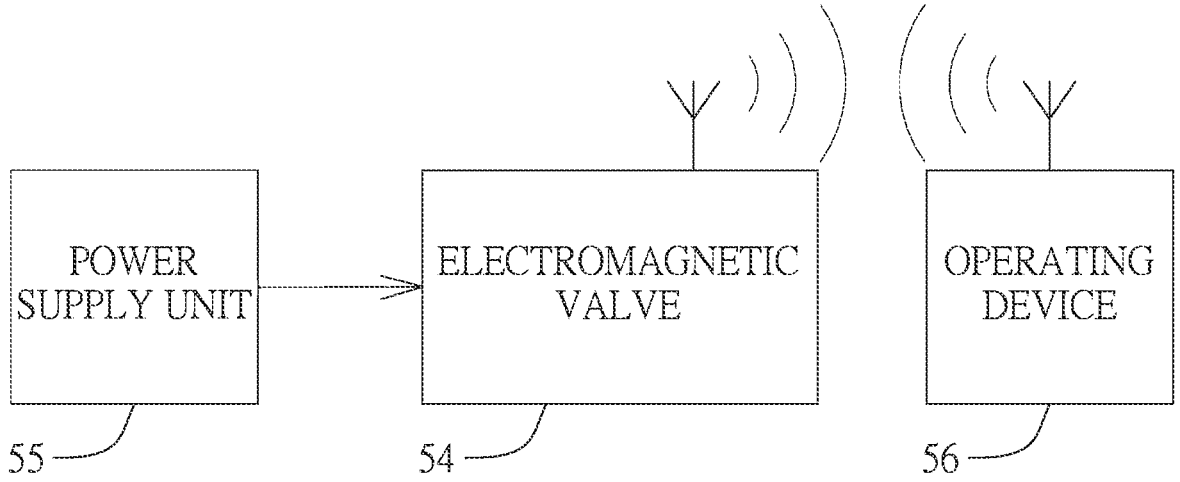
FIG. 19 is a schematic view of an electromagnetic valve, a power supply unit, and an operating device.

As also depicted in FIG. 19, the operating device 56 is a remote control with wireless signal connecting function, and the operating device 56 is signalingly connected to the electromagnetic valve 54 wirelessly. The operating device 56 can remotely control the adjusting shaft inside the electromagnetic valve 54 to switch the oil path of the hydraulic oil. However, in another embodiment, the wireless signal connecting function is not necessarily required, and the signal transmission between the operating device 56 and the electromagnetic valve 54 can be achieved through structures such as cables or other signal transmitting devices. The only requirement for the operating device 56 is to allow the user to remotely control the electromagnetic valve 54.

Figure 15:
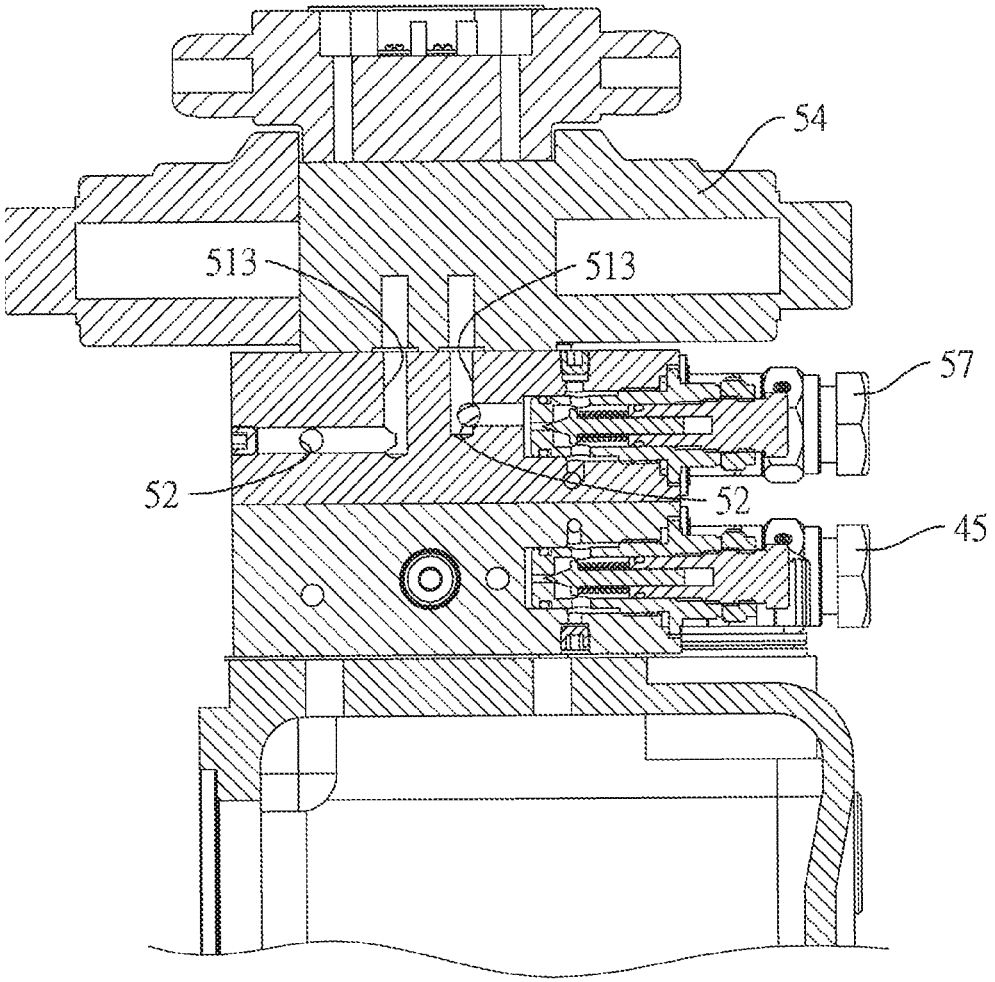
FIG. 15 is a fifth cross sectional view of the remote control unit in accordance with the present invention.

With reference to FIGS. 10, 13, and 15, the two remote pressure adjusting valves 57 are mounted on the remote unit housing 51, and communicate with the two remote unit outlets 52 respectively.

When the oil pressure of the hydraulic oil passing by is too high, the two remote pressure adjusting valves 57 can press and move an adjusting spring 571 that is mounted in the remote pressure adjusting valve 57, so the hydraulic oil will flow into the remote pressure adjusting valve 57, and finally moves back into the oil tank 21. Therefore, the remote pressure adjusting valves 57 can control the oil pressure inside the remote unit housing 51, preventing the oil pressure from getting too high.

With reference to FIG. 1, the supporting device comprises a movable rack 61 and multiple wheels 62, and the wheels 62 are mounted on the movable rack 61. The engine 10, the pump unit 20, the oil diverting device 30, the manual control unit 40, and the remote control unit 50 are all mounted on the movable rack 61.

The operating process and the advantages of the present invention are shown below.

When in use, an oil hydraulic device (not shown in figures), for example a hydraulic cutter or a hydraulic crimper, will be used along with the present invention. The hydraulic device has two connecting parts which are used to connect with the two manual unit outlets 42 of the manual control unit 40 or the two remote unit outlets 52 of the remote control unit 50. Specifically, the user may connect the hydraulic device to the manual control unit 40 or the remote control unit 50 depending on the requirements.

With reference to FIGS. 5, 6, and 10, after the connection, adjust the position of the manual diverting valve 32 and the remote diverting valve 33. If the user connects the hydraulic device to the manual control unit 40, then the user switches the manual diverting valve 32 to an open position and switches the remote diverting valve 33 to a closed position. Therefore when the hydraulic oil moves into the oil diverting device 30 from the pump unit 20, it will only move into the manual control unit 40 but not into the remote control unit 50, and vice versa.

The advantages of the present invention include:

First, with the powering of the engine 10, the present invention has an independent power supply. Therefore the present invention can be used at places such as the mountains or the seaside, where the power supply is difficult to acquire. So the present invention has a wider availability.

Second, with the remote control unit 50 connected to the hydraulic device, the user is not required to stay along the present invention to switch the oil path, but can leave the present invention and do other work while the present invention is operating, because the user can control the oil path by remotely controlling the electromagnetic valve 54 with the operating device 56. Therefore the present invention is efficient regarding the manpower.

Third, with the manual control unit 40, the user then has a backup plan when the remote control unit 50 malfunctions. The connection with the hydraulic device can be easily changed between the remote control unit 50 and the manual control unit 40. So when the remote control unit 50 is not working, the user may conveniently change the connecting unit and manually operate the present invention.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An engine-driven oil pump comprising:

an engine;

a pump unit electrically connected to the engine and comprising an oil tank, wherein an oil inlet channel is located in the oil tank and an oil outlet channel is connected to the oil tank; and an oil pumping device mounted in the oil tank, being capable of pumping hydraulic oil from an inside of the oil tank into the oil outlet channel;

an oil diverting device connecting to and communicating with the oil outlet channel, the oil diverting device comprising a diverting passage, wherein a tube inlet, a manual diverting opening and a remote diverting opening are formed on the diverting passage and are mutually communicating with one another; the tube inlet further connects and communicates to the oil outlet channel, the oil diverting device selectively closes the manual diverting opening and the oil diverting device selectively closes the remote diverting opening;

a manual control unit connected to the manual diverting opening and the oil inlet channel, and the manual control unit comprising a manual unit housing, wherein two manual unit outlets are formed on the manual unit housing, a first manual unit channel and a second manual unit channel are formed in the manual unit housing, and the first manual unit channel and the second manual unit channel communicate with the two manual unit outlets respectively; a third manual unit channel is formed in the manual unit housing, and the third manual unit channel communicates with the manual diverting opening; a bore is formed in the manual unit housing, and the bore communicates with the first manual unit channel, the second manual unit channel, and the third manual unit channel;

a manual oil regulator mounted in the bore, being capable of making the manual diverting opening communicate with any one of the two manual unit outlets;

a remote control unit connected to the remote diverting opening and the oil inlet channel, and the remote control unit comprising a remote unit housing, wherein two remote unit outlets are formed on the remote unit housing, a remote unit channel is formed in the remote unit housing, and the remote unit channel communicates with the remote diverting opening and the two remote unit outlets;

an electromagnetic valve, an inside of the electromagnetic valve communicating with the remote unit channel, the electromagnetic valve being capable of making the remote diverting opening communicate with any one of the two remote unit outlets;

a power supply unit electrically connected to the electromagnetic valve;

an operating device signalingly connected to the electromagnetic valve;

two manual pressure adjusting valves mounted on the manual control unit, and one of the two manual pressure adjusting valves communicating with one of the two manual unit outlets; and two remote pressure adjusting valves mounted on the remote control unit, and the two remote pressure adjusting valves communicating with the two remote unit outlets respectively.

2. The engine-driven oil pump as claimed in claim 1, wherein the diverting passage of the oil diverting device is formed in the manual unit housing, an end of the diverting passage extends into the remote unit housing, the manual diverting opening is formed in the manual unit housing, and the remote diverting opening is formed in the remote unit housing.

3. The engine-driven oil pump as claimed in claim 2, wherein the oil diverting device further comprises a manual diverting valve mounted on the manual unit housing, being adjacent to the manual diverting opening, and selectively opening or closing the manual diverting opening; and a remote diverting valve mounted on the remote unit housing, being adjacent to the remote diverting opening, and selectively opening or closing the remote diverting opening.

4. The engine-driven oil pump as claimed in claim 3, wherein the manual diverting valve comprises a diverting handle rotatably mounted on the manual unit housing and extending into the manual unit housing;

an adjusting shaft mounted in the third manual unit channel and connected to the diverting handle; and a bung mounted in the third manual unit channel and connected to the adjusting shaft, the diverting handle being capable of moving the adjusting shaft inside the third manual unit channel to selectively close the manual diverting opening by the bung.

5. The engine-driven oil pump as claimed in claim 4, wherein the remote diverting valve comprises a diverting handle rotatably mounted on the remote unit housing and extending into the remote unit housing;

an adjusting shaft mounted in the remote unit channel and connected to the diverting handle; and a bung mounted in the remote unit channel and connected to the adjusting shaft, the diverting handle being capable of moving the adjusting shaft inside the remote unit channel to selectively close the remote diverting opening by the bung.

6. The engine-driven oil pump as claimed in claim 5, wherein the electromagnetic valve further comprises an inlet communicating hole formed in the electromagnetic valve and communicating with the remote unit channel;

an outlet communicating hole formed in the electromagnetic valve and communicating with the oil inlet channel;

two pump communicating inlets formed in the electromagnetic valve and communicating with the two remote unit outlets respectively;

wherein the electromagnetic valve is capable of making the inlet communicating hole communicate with any one of the two pump communicating inlets and simultaneously the outlet communicating hole communicate with the other one of the two pump communicating inlets.

7. The engine-driven oil pump as claimed in claim 6 further comprising:

a movable rack; and multiple wheels mounted on the movable rack and arranged apart from each other, the movable rack being moved by the wheels, wherein the engine, the pump unit, the oil diverting device, the manual control unit, and the remote control unit are mounted on the movable rack.

8. The engine-driven oil pump as claimed in claim 7, wherein the power supply unit is an electromagnetic coil.

9. The engine-driven oil pump as claimed in claim 8, wherein the operating device and the electromagnetic valve are signalingly connected wirelessly.

10. The engine-driven oil pump as claimed in claim 1, wherein the oil diverting device further comprises a manual diverting valve mounted on the manual unit housing, being adjacent to the manual diverting opening, and selectively opening or closing the manual diverting opening; and a remote diverting valve mounted on the remote unit housing, being adjacent to the remote diverting opening, and selectively opening or closing the remote diverting opening.

11. The engine-driven oil pump as claimed in claim 10, wherein the manual diverting valve comprises a diverting handle rotatably mounted on the manual unit housing and extending into the manual unit housing;

an adjusting shaft mounted in the third manual unit channel and connected to the diverting handle; and a bung mounted in the third manual unit channel and connected to the adjusting shaft, the diverting handle being capable of moving the adjusting shaft inside the third manual unit channel to selectively close the manual diverting opening by the bung.

12. The engine-driven oil pump as claimed in claim 10, wherein the remote diverting valve comprises a diverting handle rotatably mounted on the remote unit housing and extending into the remote unit housing;

an adjusting shaft mounted in the remote unit channel and connected to the diverting handle; and a bung mounted in the remote unit channel and connected to the adjusting shaft, the diverting handle being capable of moving the adjusting shaft inside the remote unit channel to selectively close the remote diverting opening by the bung.

13. The engine-driven oil pump as claimed in claim 1, wherein the electromagnetic valve further comprises an inlet communicating hole formed in the electromagnetic valve and communicating to the remote unit channel;

an outlet communicating hole formed in the electromagnetic valve and communicating to the oil inlet channel;

two pump communicating inlets formed in the electromagnetic valve and communicating to the two remote unit outlets respectively;

wherein the electromagnetic valve is capable of making the inlet communicating hole communicate with any one of the two pump communicating inlets and simultaneously the outlet communicating hole communicate with the other one of the two pump communicating inlets.

14. The engine-driven oil pump as claimed in claim 1 further comprising:

a movable rack; and multiple wheels mounted on the movable rack and arranged apart from each other, wherein the engine, the pump unit, the oil diverting device, the manual control unit, and the remote control unit are mounted on the movable rack.

15. The engine-driven oil pump as claimed in claim 1, wherein the power supply unit is an electromagnetic coil.

16. The engine-driven oil pump as claimed in claim 1, wherein the operating device and the electromagnetic valve are signalingly connected wirelessly.

* * * * *